US010166668B2

(12) United States Patent
Baskar et al.

(10) Patent No.: US 10,166,668 B2
(45) Date of Patent: Jan. 1, 2019

(54) POWER DRIVEN SCREWDRIVER

(71) Applicant: BLACK & DECKER INC., New Britain, CT (US)

(72) Inventors: Ashok Samuel Baskar, Lutherville, MD (US); Drake L. Fisher, Baltimore, MD (US); James W. Richards, Baltimore, MD (US)

(73) Assignee: BLACK & DECKER INC., New Britain, CT (US)

( * ) Notice: Subject to any disclaimer, the term of this patent is extended or adjusted under 35 U.S.C. 154(b) by 306 days.

(21) Appl. No.: 15/068,905

(22) Filed: Mar. 14, 2016

(65) Prior Publication Data

US 2017/0144292 A1 May 25, 2017

Related U.S. Application Data

(60) Provisional application No. 62/257,534, filed on Nov. 19, 2015.

(51) Int. Cl.
*B25B 21/00* (2006.01)
*B25F 5/02* (2006.01)

(52) U.S. Cl.
CPC ..... *B25F 5/029* (2013.01); *B25B 21/00* (2013.01)

(58) Field of Classification Search
CPC .. B25B 21/00; B25F 1/04; B25F 5/029; B25F 1/02; B25G 1/08; B25G 1/085
See application file for complete search history.

(56) References Cited

U.S. PATENT DOCUMENTS

| | | | | |
|---|---|---|---|---|
| 1,579,498 A | | 4/1926 | Anderson | |
| 3,426,813 A | | 2/1969 | Robertson | |
| 4,227,430 A | | 10/1980 | Jansson et al. | |
| 4,463,788 A | | 8/1984 | Corona et al. | |
| 4,772,765 A | * | 9/1988 | Markle | H01H 9/063 200/1 V |

(Continued)

FOREIGN PATENT DOCUMENTS

| | | | | |
|---|---|---|---|---|
| DE | 3514023 | | 10/1986 | |
| DE | 29803993 U1 | * | 4/1998 | B25B 15/00 |

(Continued)

OTHER PUBLICATIONS

EP Search Report dated Mar. 3, 2017, for EP Application No. 16199211.0.

*Primary Examiner* — Joseph J Hail
*Assistant Examiner* — Arman Milanian
(74) *Attorney, Agent, or Firm* — Stephen R. Valancius

(57) ABSTRACT

A screwdriving including a housing with a handle section and a motor housing section. A longitudinal axis of the handle section is at an offset angle with respect to a longitudinal axis of the motor housing section. A motor is housed in the motor housing section. An output tool holder is selectively driven by the motor. A user actuatable trigger activates the motor. The screwdriver further includes a bit holder rotatably held on the housing, the bit holder including a first section which includes a plurality of bit retainers; and a second section including a plurality of detents. The screwdriver further includes a pin which engages with the plurality of detents to hold the bit holder in one of a plurality of rotational positions.

19 Claims, 11 Drawing Sheets

(56) References Cited

U.S. PATENT DOCUMENTS 4,932,294 A * 6/1990 Chang ..... B25F 5/02 206/234
4,973,205 A * 11/1990 Spaulding ..... B25F 5/021 206/379
4,976,175 A * 12/1990 Hung ..... B25F 5/029 81/177.5
5,121,803 A 6/1992 Hartmann et al.
5,265,504 A 11/1993 Fruhm
5,346,453 A * 9/1994 Rivera-Bottzeck ..... B23Q 3/1574 279/902
5,733,034 A * 3/1998 Jan ..... B25B 15/02 362/119
5,749,271 A 5/1998 Liu
6,134,995 A * 10/2000 Shiao ..... B25F 1/02 81/177.4
6,273,200 B1 8/2001 Smith et al.
6,305,815 B1 * 10/2001 Lin ..... B25G 1/043 362/119
6,334,743 B1 1/2002 Liao
6,467,556 B2 10/2002 Alsruhe
6,502,484 B2 * 1/2003 Pao-Hsi ..... B25B 15/02 81/439
6,510,768 B2 * 1/2003 Fruhm ..... B25B 21/00 81/177.4
6,902,356 B2 6/2005 Breitenmoser
6,968,760 B2 11/2005 Hu
6,997,088 B2 2/2006 Hu
7,086,314 B2 8/2006 Wannop
7,258,046 B2 8/2007 Fruhm et al.
7,395,739 B1 7/2008 Chen
7,779,732 B2 8/2010 Abel et al.
7,993,023 B2 8/2011 Wang
8,007,424 B2 * 8/2011 Moser ..... B25B 21/00 408/35
8,047,100 B2 11/2011 King
8,413,549 B2 * 4/2013 Chen ..... B25B 15/04 81/177.2
8,590,432 B2 11/2013 Wang
8,833,214 B2 9/2014 Wang
2006/0104732 A1 5/2006 Huang
2006/0254396 A1 * 11/2006 Hu ..... B25G 1/085 81/177.4
2011/0203821 A1 8/2011 Puzio et al.
2013/0032368 A1 * 2/2013 Zhang ..... B25F 5/029 173/1
2013/0244845 A1 * 9/2013 Nagy ..... B25F 5/029 483/12
2014/0329654 A1 11/2014 Andriolo et al.

FOREIGN PATENT DOCUMENTS

DE 202005018772 3/2006
DE 102011087294 5/2013
DE 202013004302 U1 * 6/2013 ..... B25F 5/029
EP 1105254 6/2001
EP 1105254 11/2002
EP 2101960 9/2009
EP 2570239 3/2013
EP 2636490 9/2013
EP 2740571 6/2014
EP 2803451 11/2014
EP 1924408 3/2015
GB 396874 1/1933
GB 2397513 7/2004
JP 5656388 5/1981
JP 56056388 5/1981
WO WO199412322 6/1994
WO WO 0009295 A1 * 2/2000 ..... B25F 5/029
WO WO200009295 2/2000
WO WO02100603 12/2002
WO WO2007025369 3/2007
WO WO2011017794 2/2011
WO WO20140146512 9/2014

* cited by examiner

POWER DRIVEN SCREWDRIVER

CROSS-REFERENCE TO RELATED APPLICATIONS

This application claims the benefit of U.S. Provisional Application No. 62/257,534, filed on Nov. 19, 2015, entitled Power Driven Screwdriver. The entire contents of U.S. Provisional Application No. 62/257,534 are incorporated herein by reference.

FIELD OF THE INVENTION

The present invention relates to a power tool, particularly a screwdriving with built-in bit storage.

BACKGROUND

There are various existing screwdrivers. It is desired to provide an improved screwdriver with built-in storage.

SUMMARY

According to an exemplary embodiment, there is a screwdriver. The screwdriver includes a housing comprising a handle section and a motor housing section, a longitudinal axis of the handle section being at an offset angle with respect to a longitudinal axis of the motor housing section. A motor is housed in the motor housing section. A tool holder is selectively driven by the motor. A user actuatable trigger for activating the motor. A bit holder is rotatably held on the housing, the bit holder comprising a first section which includes a plurality of bit retainers and a second section including a plurality of detents. The screwdriver includes a pin which engages with the plurality of detents to hold the bit holder in one of a plurality of rotational positions.

The bit holder further may further include a plate adjacent the bit retainers.

The plate may be configured to prevent axial movement of bits held in the bit retainers.

The screwdriver may further include a movable cover which selectively covers at least some of the plurality of bit retainers.

The cover may be movable to an open position in which at least one bit retainer is accessible to a user.

The cover may be in the open position, the user can rotate the bit holder.

There may be at least three detents.

There may be at least five detents.

The bit holder may be fixed in an axial direction.

The bit holder may include a substantially cylindrical body.

The substantially cylindrical body may be at least substantially hollow.

The screwdriver may include a bit holder section including a bit holder housing and wherein the bit holder is rotatably mounted to the bit holder housing.

The cover may be mounted on the bit holder housing.

The bit holder may have a longitudinal axis that is aligned with the longitudinal axis of the motor housing.

The bit holder may be rotatable around the bit holder longitudinal axis.

The bit holder housing may be integral with the handle section and a motor housing section.

The cover may have a window through which a user can see bits held by at least some of the bit retainers.

The cover may be rotatable.

The cover may be rotatable about the longitudinal axis of the motor housing.

According to another aspect there is an exemplary embodiment of a power tool, the power tool including a housing comprising a handle section and a motor housing section, a longitudinal axis of the handle section being at an offset angle with respect to a longitudinal axis of the motor housing section. A motor is housed in the motor housing section. A tool holder selectively driven by the motor. A user actuatable trigger for activating the motor. A bit holder rotatably held on the housing, the bit holder comprising a first section which includes a plurality of bit retainers. A second section including a plurality of detents. The power tool further includes a pin which engages with the plurality of detents to hold the bit holder in one of a plurality of rotational positions. The bit holder is located axially behind the motor housing section along the motor housing section longitudinal axis, wherein the tool holder side of the power tool constitutes a forward direction.

The power tool may further include a movable cover which selectively covers at least some of the plurality of bit retainers.

DETAILED DESCRIPTION OF EXEMPLARY EMBODIMENTS

FIGS. 1-9 illustrate an exemplary embodiment of a screwdriver with on-board bit storage. The basic functioning of screwdrivers is well known and is shown, for example, in U.S. Pat. Nos. 4,772,765; 6,467,556; 6,273,200; 8,047,100; and US Patent Application Publication No. 2011/0203821. U.S. Pat. Nos. 4,772,765; 6,467,556; 6,273,200; 8,047,100; and US Patent Application Publication No. 2011/0203821 are all herein incorporated by reference in their entireties.

Figure 1:
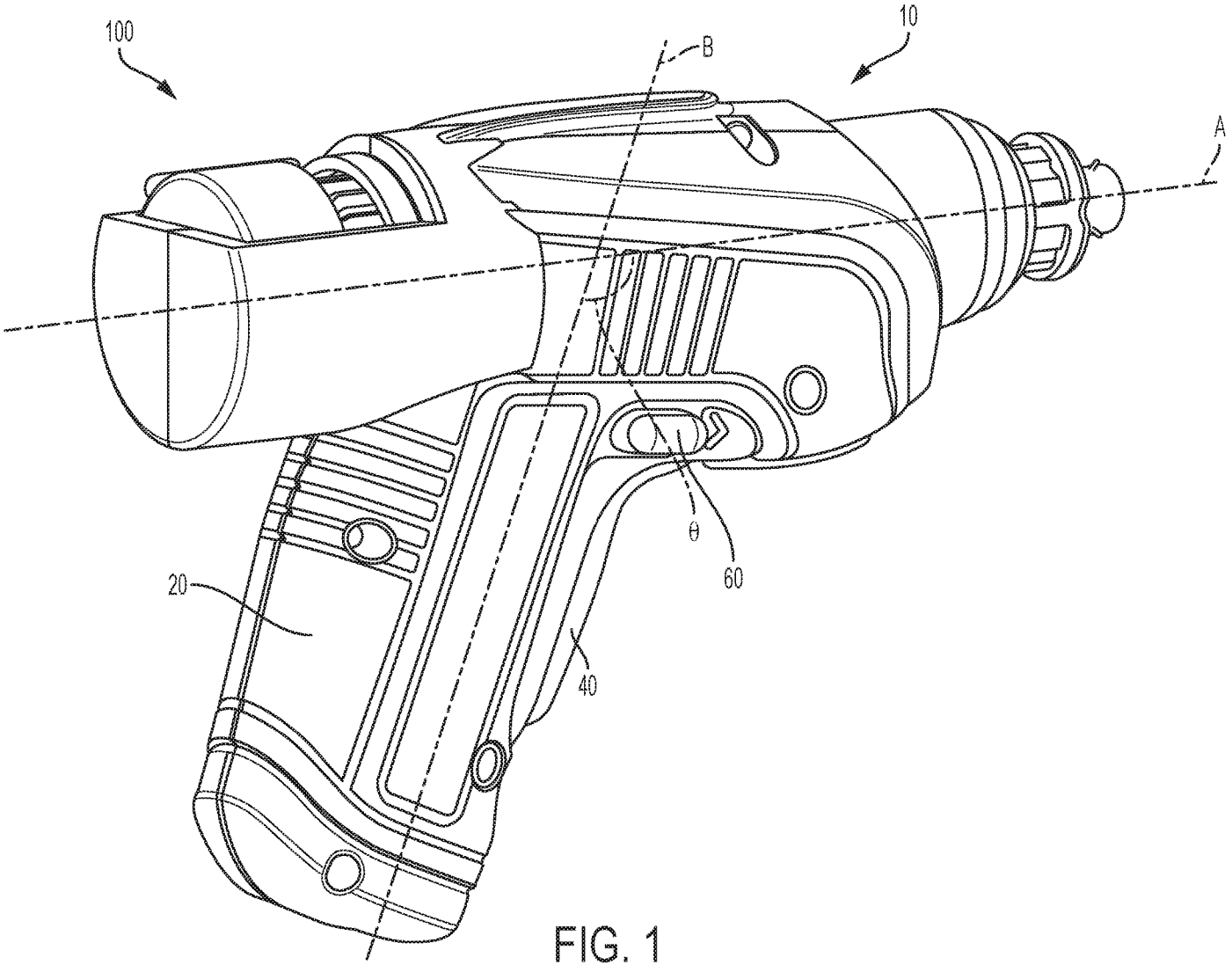
FIG. 1 illustrates a perspective view of an exemplary embodiment of a screwdriver.

As shown in FIG. 1, the screwdriver 10 of the exemplary embodiment is a pistol grip type screwdriver, meaning that the handle portion 20 is disposed at an angle with respect to the motor housing portion 30. For example, a longitudinal axis A of the motor housing portion 30 may be disposed at an angle θ of between 45 and 135 degrees with respect to a longitudinal axis B of the handle portion 20. A user actuable trigger switch 40 is disposed at the front of the handle to activate the screwdriver 10. A direction selection switch 60 is located generally above the switch.

As shown in FIG. 1, the screwdriver further includes an on-board bit storage 100. The bit storage 100 includes a housing portion 110. The housing portion 110 may be integrally formed with the rest of the screwdriver housing, particularly the handle portion 20 and the motor portion 30. Alternatively, it may be a separate attachable part. The bit storage 100 also includes a cover 170. As shown in FIG. 1, the bit storage is located along a longitudinal axis of the motor housing 30 and above the handle 20. Details of the bit storage 100 will be described below in further detail.

Figure 2:
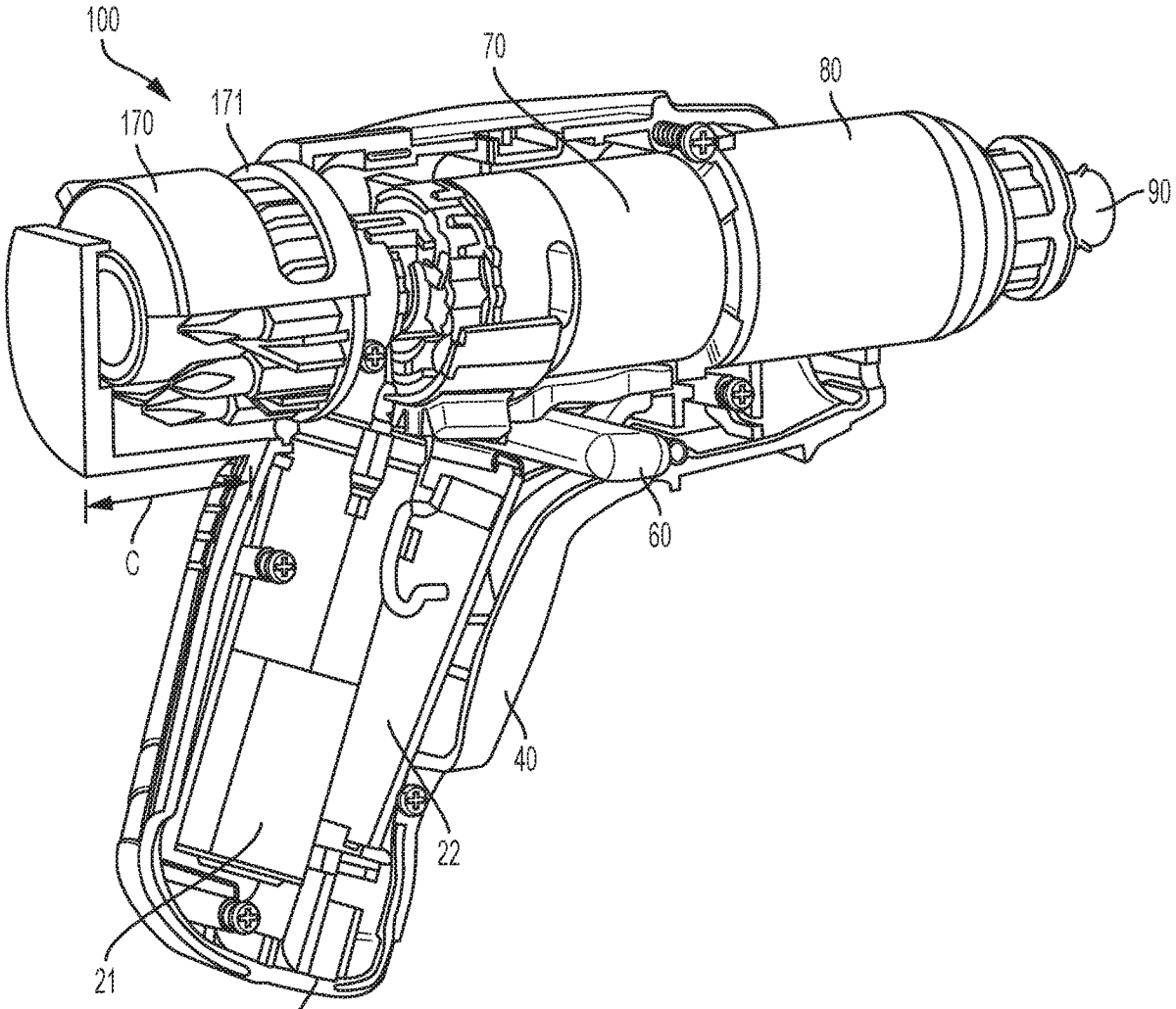
FIG. 2 is another perspective view of the exemplary embodiment of screwdriver with the housing partially removed.
Figure 3:
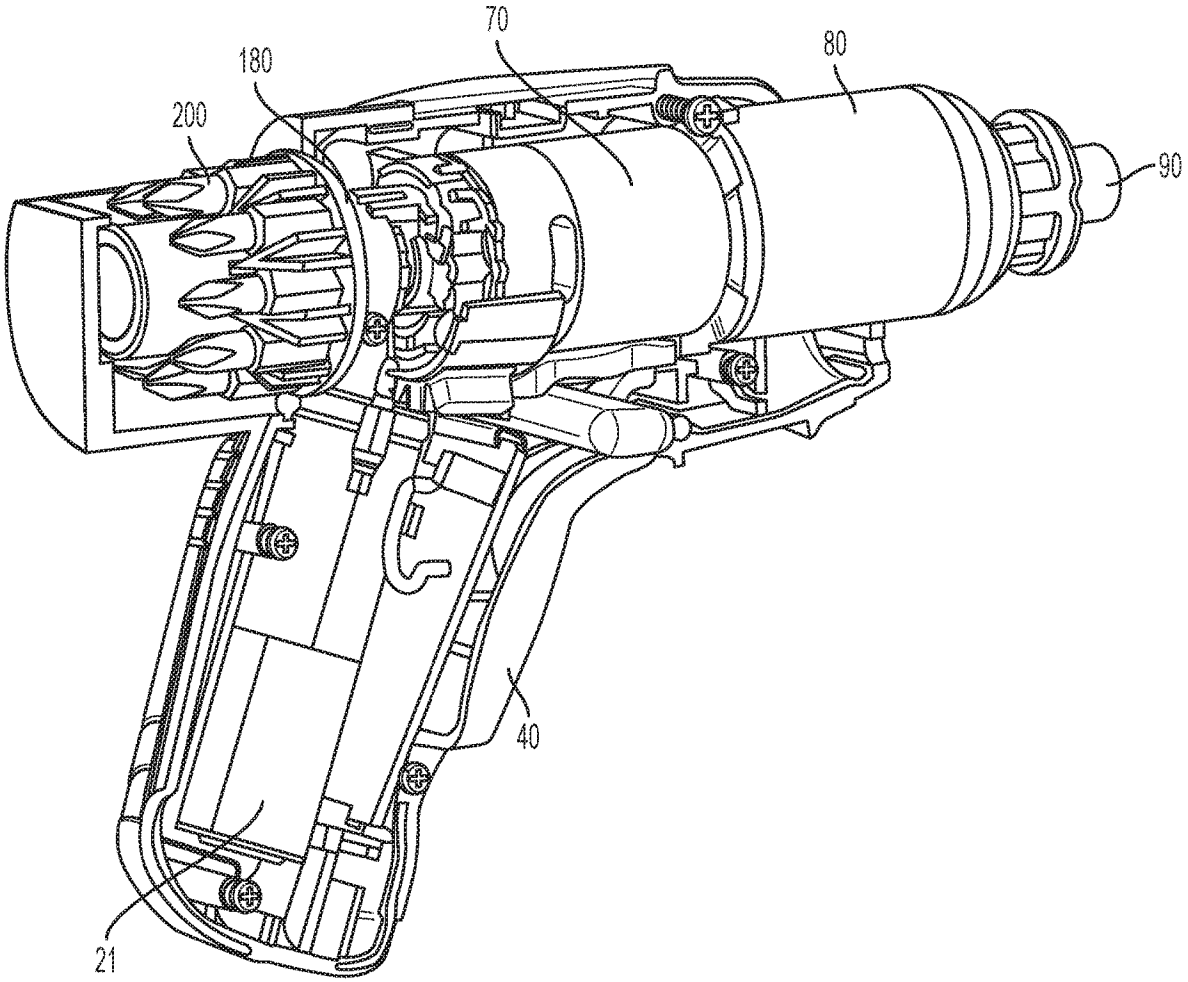
FIG. 3 is another perspective view of the exemplary embodiment of screwdriver with the housing partially removed.

FIGS. 2 and 3 are another view of the screwdriver 10 with the housing partially removed. As shown in FIGS. 2 and 3, the screwdriver 10 includes a rechargeable battery cell 21 located in the handle 20. The battery cell 21 is connected to a circuit board 22, the circuit board also being connected to the user actuable trigger switch 40 and the motor 70. As shown, the motor 70 is disposed in the motor housing portion 30. A transmission assembly 80 is provided forward of the motor 70 and extends outwardly from the motor housing portion 30. The motor 70 drives the tool holder 90 through the transmission 80. The tool holder 90 in the exemplary embodiment is a hex bit holder. This type of tool holder holds the bits 200 held by the bit holder 130 (described in further detail below) so that a user can use the bits 200 held by the bit holder 130 in the tool holder 90. In other embodiments, the transmission 80 may be omitted or may be an adjustable transmission. A charging port hole 23 is provided at a bottom of the handle 20 for providing access to charge the battery cell 21.

Figure 4B:
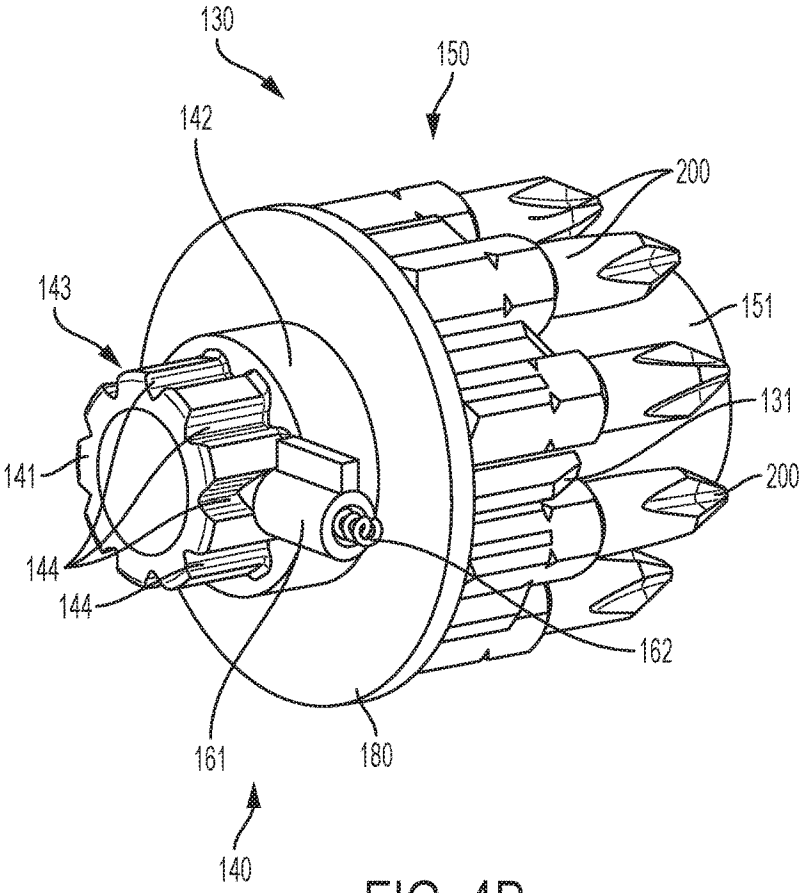
FIG. 4B is another view of an exemplary embodiment of a detent section of the screwdriver.

The bit storage 100 will now be described in further detail with reference to FIGS. 1-9. FIG. 4B illustrates a bit holder 130. The bit holder 130 is mounted on the bit storage housing 110. As shown in FIG. 4B, the bit holder 130 includes a generally cylindrical body and is hollow in the exemplary embodiment. The bit holder 130 has a front section 140 with a front end 141 which faces toward the motor 70 and a rear section 150 at the opposite end with a rear end 151 which faces the opposite direction. Around an outer surface of the rear section 150, there are a plurality of bit retainers 131. The bit retainers 131 retain a plurality of bits 200 around the outside of the rear section 150. The front section includes a mounting portion 142 as well as a detent section 143. Additionally, the bit holder 130 includes a plate 180, which separates the front section 140 and rear section 150. The plate 180 supports a rear surface of the bits 200 and prevents them from sliding forward toward the front section 140. It is noted that in FIG. 4B, for the purposes of illustrating the front section 140, the bit holder 130 is shown in an orientation opposite of the orientation in which it is mounted in the screwdriver 10. Particularly, with reference to FIGS. 4A and 4B, the front end 141 of the front section 140 is disposed at the front retainer 111 shown in FIG. 4A and the end 151 of the rear section 150 fits into the rear retainer 112 shown in FIG. 4A.

Figure 4A:
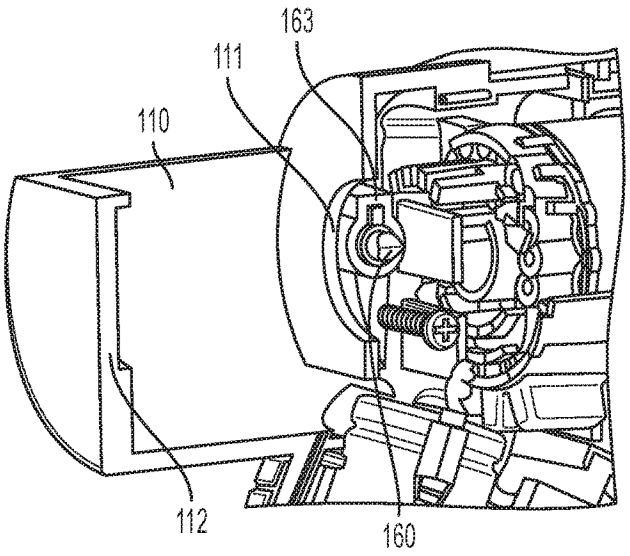
FIG. 4A is a view of an exemplary embodiment of a detent section of the screwdriver.
Figure 5:
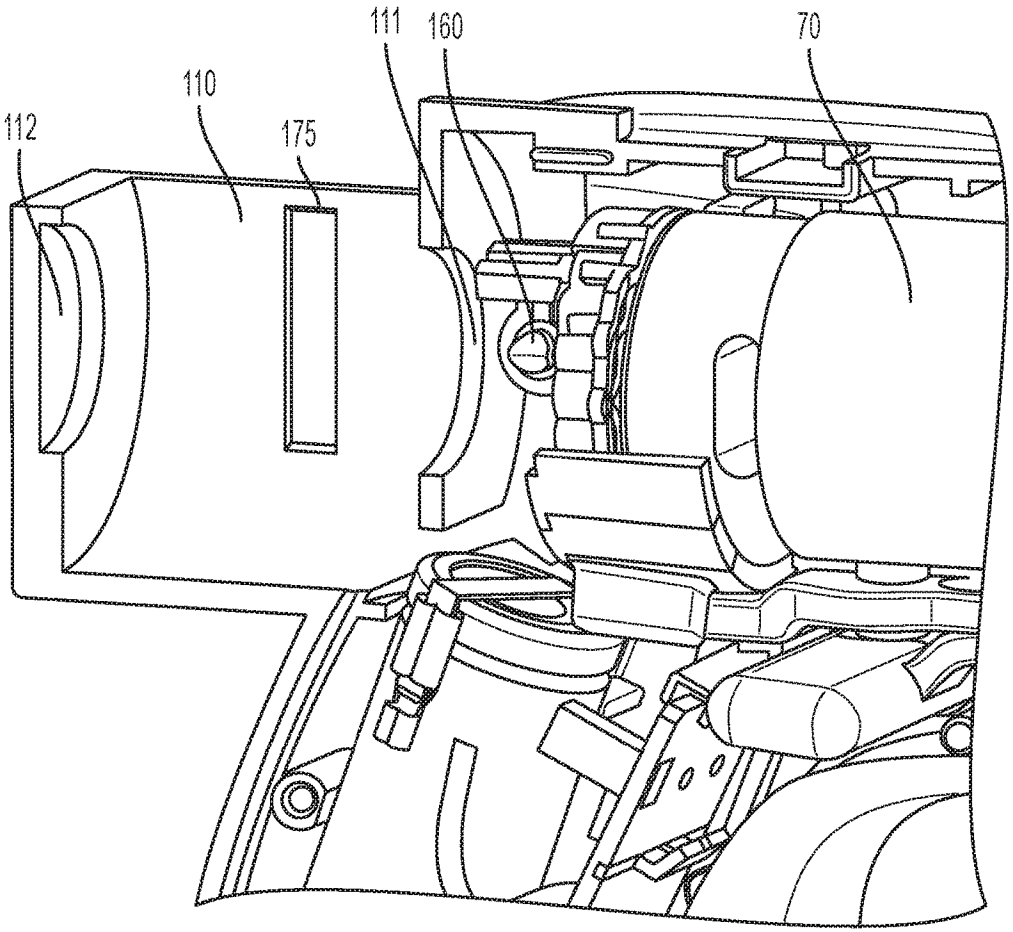
FIG. 5 is a cut-away view of an exemplary embodiment of an on-bit storage housing with the bit holder removed.
Figure 6:
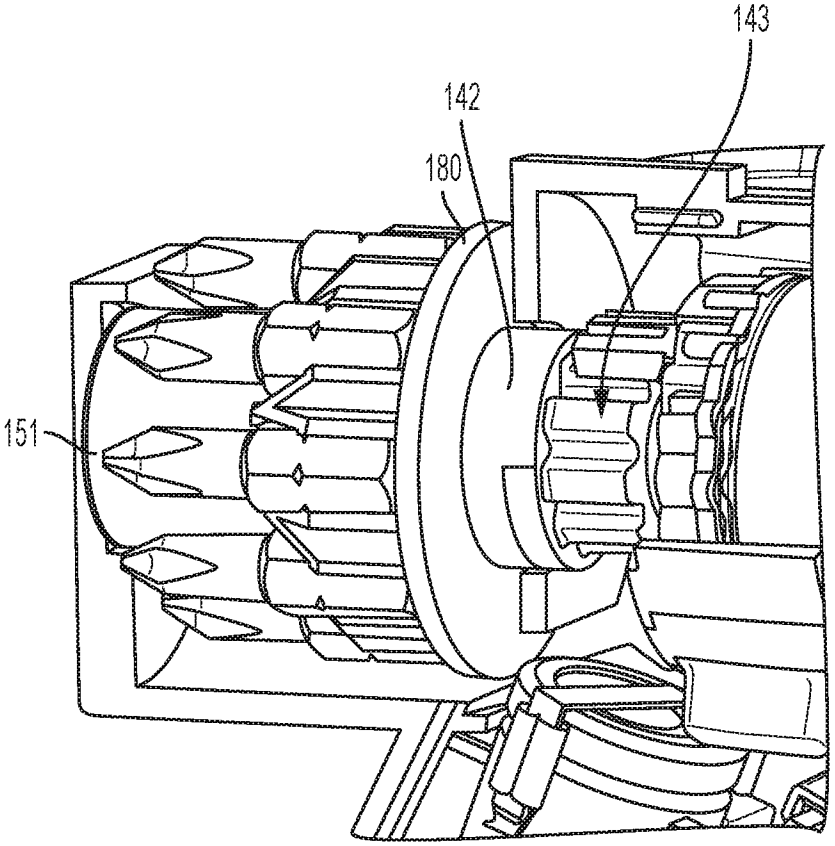
FIG. 6 is a cut-away view of an exemplary embodiment of the bit storage section.
Figure 7:
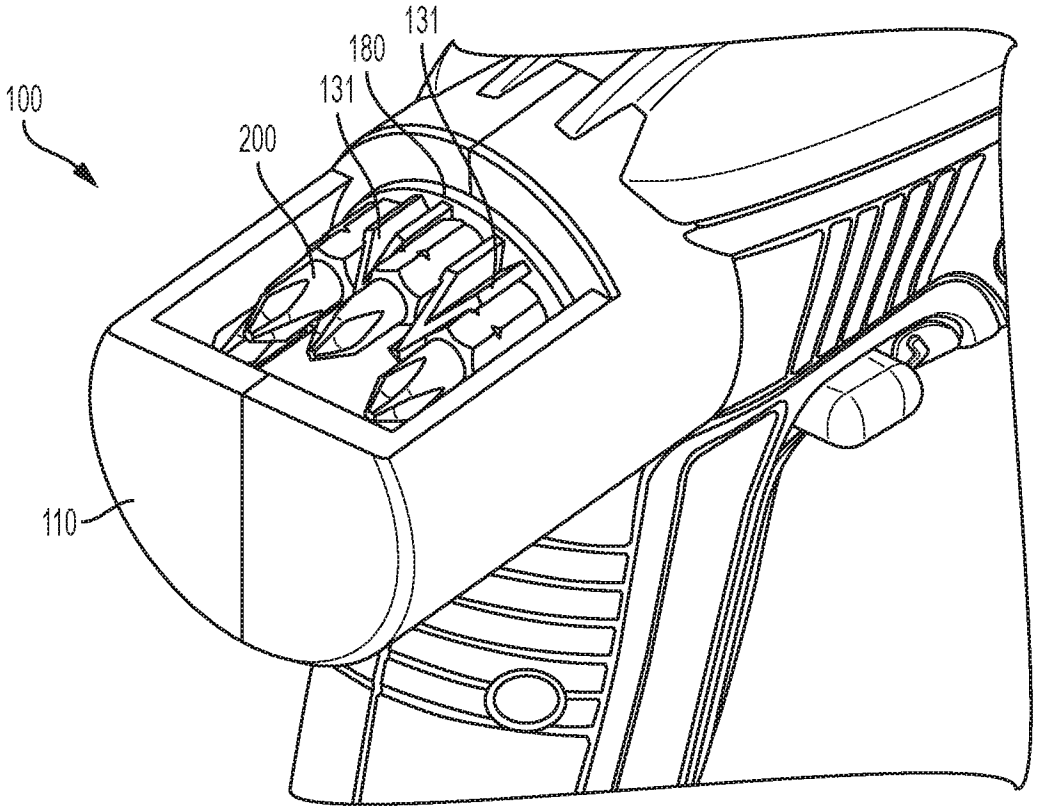
FIG. 7 is another view of an exemplary embodiment of the bit storage section.

FIG. 5 illustrates the half of the bit storage housing 110 with the bit holder 130 removed. FIG. 6 includes the mounted bit holder 130. As shown in FIGS. 4A, 5 and 6, the bit storage housing includes a front retainer 111 and a rear retainer 112. As noted above, the front end 141 of the front section 140 is disposed at and passes through the front retainer 111. The mounting portion 142 is received in the front retainer 111. As will be appreciated, the smooth surfaces of the front retainer 111 and the mounting portion 142 allow for relative rotation. The rear retainer 112 receives the rear end 151 of the rear section 150. In this manner, the bit holder 130 is rotatably mounted in the housing section 110. In the exemplary embodiment, the front retainer 111 and the rear retainer 112 are integrally formed with the housing. In other embodiments, the retainers may be formed with a different structure.

Figure 8:
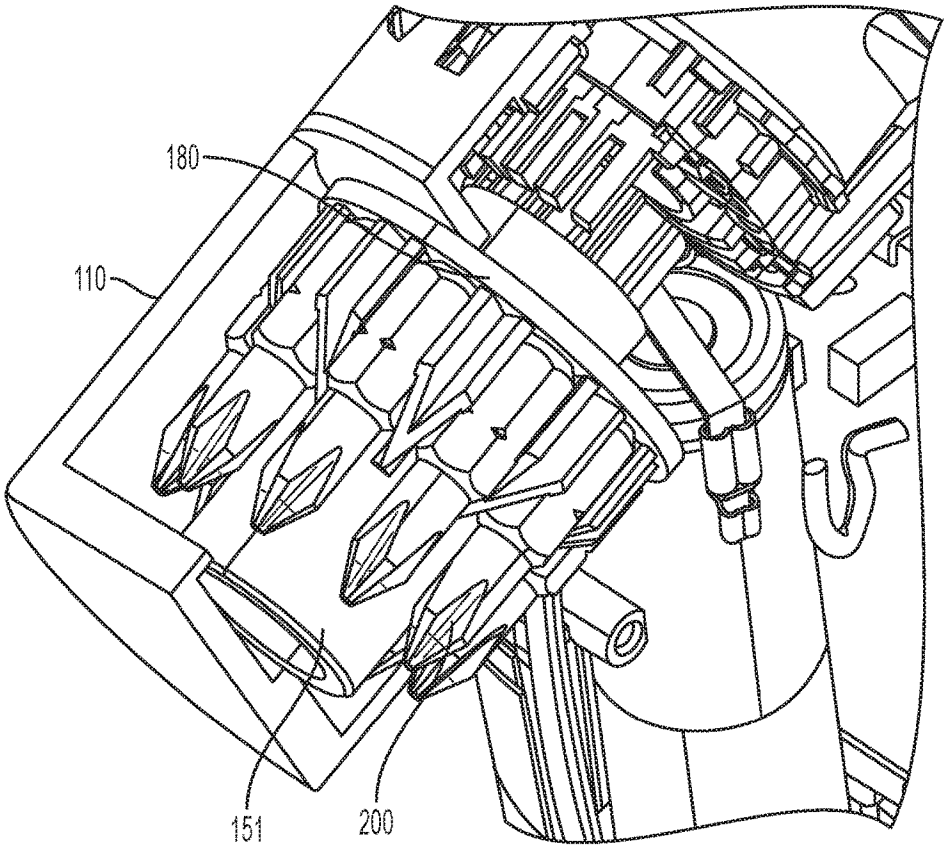
FIG. 8 is another cut away view of an exemplary embodiment of the bit storage section.

As previously discussed, the bit holder 130 includes a detent section 143. The detent section 143 is generally cylindrical and hollow with a series of detents 144 formed on an outer surface thereof. As shown in FIGS. 6 and 8, the detent section 143 protrudes through the front retainer 111. As shown in FIGS. 4A and 4B, the screwdriver includes a pin 160 formed in a pin retainer 161 and biased by a spring 162. The pin retainer 161 is housed into a housing portion 163 of roughly corresponding shape, as shown in FIG. 4A. The spring 162 biases the pin 160 toward the detent section 143. As will be appreciated, the pin 160 interacts with the detents 144 to hold the bit holder 130 in place so that it does not rotate unless under load. The spring force is set such that a user can rotate (the bit holder 130 to expose different bits 200. That is, the user can apply a load sufficient to rotate the bit holder 130.

In the exemplary embodiment, the detent section 143 includes nine detents 144, which allows the bit holder 130 to be set in nine different rotational positions. The nine different rotational positions correspond to nine different bit retainers 131. Alternatively, there could be more or fewer detents 144 than bit retainers 131. For example, there could be seven detents 144 and nine bit retainers 131.

Figure 9:
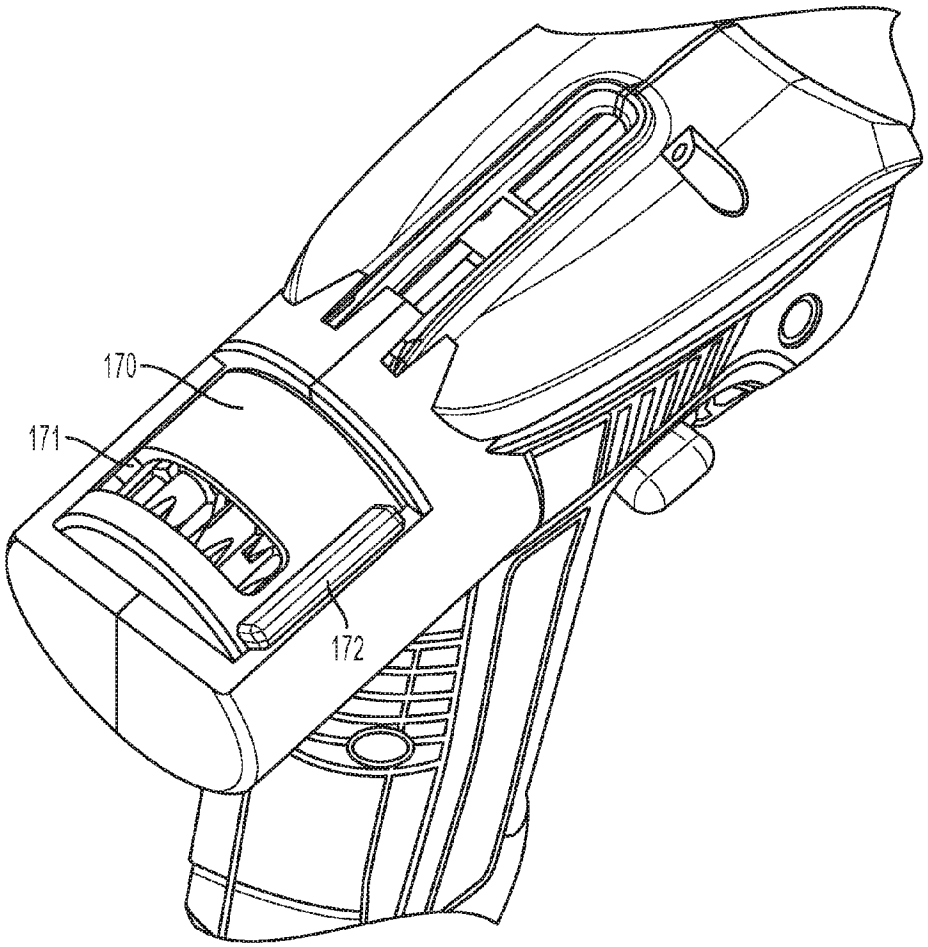
FIG. 9 is another view of an exemplary embodiment of the bit storage section with the cover closed.
Figure 10:
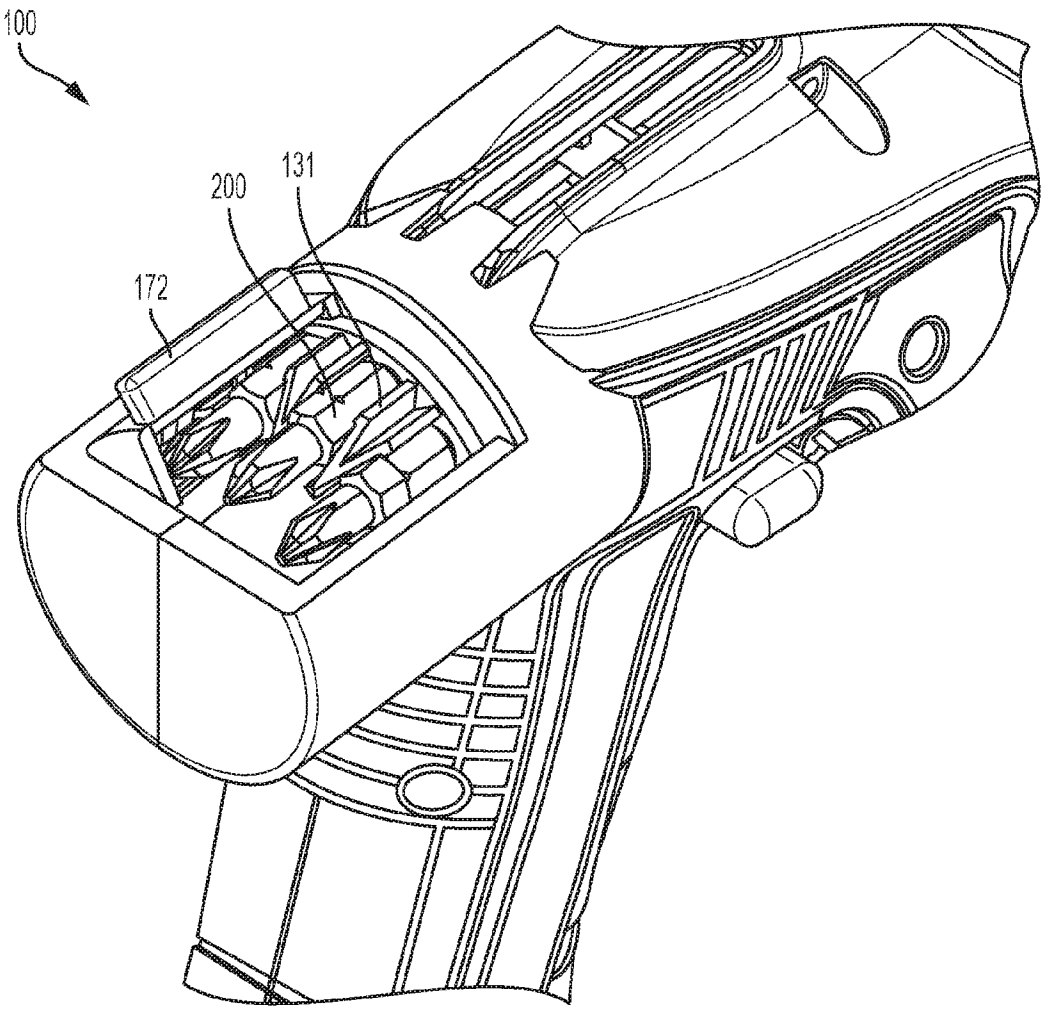
FIG. 10 is another view of an exemplary embodiment of the bit storage section with the cover open.

The cover 170 is best shown in FIGS. 9 and 10. As shown in FIGS. 9 and 10, the cover 170 includes a window 171 and a user grip 172 in the form of a projection. As shown in FIG. 9, when the cover 170 is closed, any inadvertent loss of the bits 200 is prevented. The user can then open the cover 170 to the position shown in FIG. 10 to remove a bit. Once removed, the bit 200 can be inserted in the front bit holder 90 and used for screwdriving. As previously described, the bit holder 130 is rotatable. Accordingly, once the cover 170 is open, the user can rotate the bit holder 130 in order to move different bits 200 to the top position where they are exposed and can be retrieved by the user. Various bits 100 of different types can be placed in the bit holder 130 so that the user can complete a number of different tasks.

Figure 11:
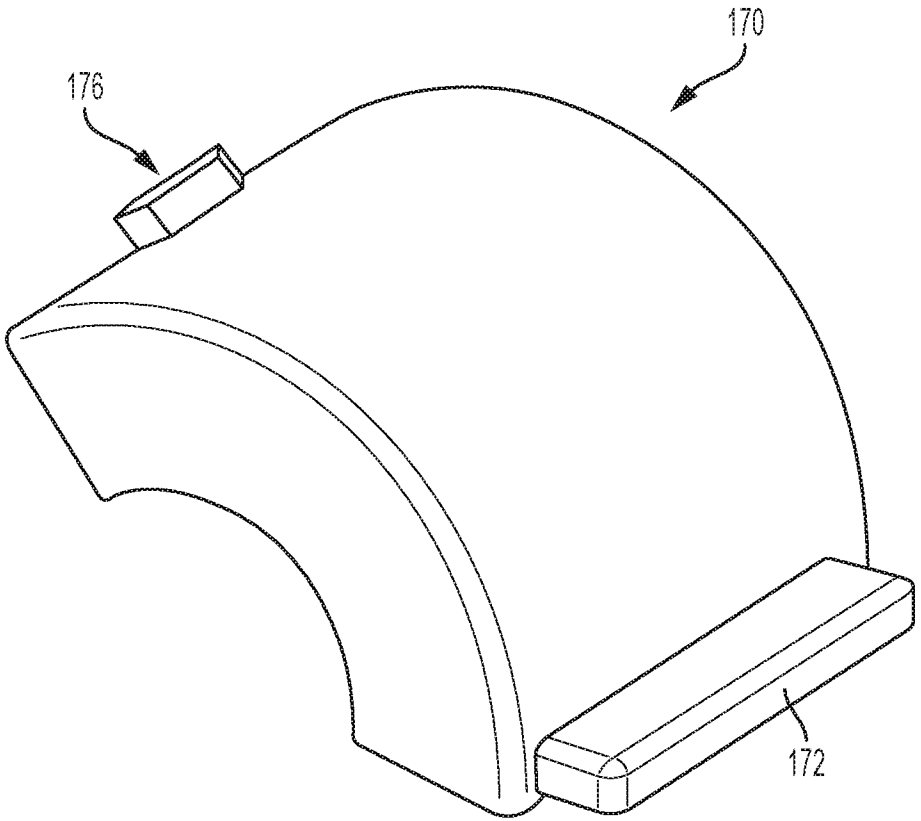
FIG. 11 is an illustration of the exemplary embodiment of the cover part.

FIG. 11 illustrates the cover 170 alone. In this embodiment, the cover 170 does not include a window. As shown, the cover 170 includes a guide part in the form of a projection 176. The projection 176 fits into a recess 175 formed into the bit section housing 110. FIG. 5 of the present application shows the recess 175. As can be appreciated, the projection 176 slides from one end of the recess to the other as the cover 170 moves between the open and closed positions. When the projection reaches either end of the recess 175, the end of the recess blocks the projection 176 from moving any further. In this manner, the cover 170 can be retained in the bit holder housing 110. Other methods are also possible. For example, the housing 110 could include a projection and the cover 170 could include a groove/recess for receiving a projection from the housing 110.

A screwdriver 10 according to the exemplary embodiment can be advantageous for various reasons. As previously noted, a user of the screwdriver 10 can carry a number of different bits 200 for a variety of different jobs. The exemplary embodiment allows for a compact design. For example, a user can get to the bits 200 without any axial movement of the bit holder 130 or other part. Additionally, the bit holding section 100 does not extend unnecessarily rearward. For example, when the screwdriver is held such that the longitudinal axis A is held parallel to the ground, the bit holding section 100 of an exemplary embodiment may not extend rearward of the rear of the handle 20. In other embodiments, the bit holding section may extend 5 cm or less rearward of the handle; 3 cm or less rearward of the handle or 2 cm or less rearward of the handle or 1 cm or less rearward of the handle.

Additionally, the handle 20 meets the rest of the screwdriver at a position between the bit holder 130 and the motor 70. This allows for a balanced screwdriver that is neither front-heavy or rear heavy. A distance C from the point where the back of the handle meets the bit holder housing section 110 to the rear of the bit holder housing section 110 may be 7 cm or less; 5 cm or less; or 4 cm or less.

While the invention has been described by way of exemplary embodiments, it is understood that the words which have been used herein are words of description, rather than words of limitation. Changes may be made within the purview of the appended claims, without departing from the scope and spirit of the invention in its broader aspects.

What is claimed is:

1. A screwdriver, comprising:

a housing comprising a handle section and a motor housing section, a longitudinal axis of the handle section being at an offset angle with respect to a longitudinal axis of the motor housing section;

a motor housed in the motor housing section;

a tool holder selectively driven by the motor;

a user actuatable trigger for activating the motor; and a bit holder rotatably held on the housing, the bit holder comprising a first section which includes a plurality of bit retainers and a second section including a plurality of detents;

wherein the screwdriver further comprises a pin which engages with the plurality of detents to hold the bit holder in one of a plurality of rotational positions;

further comprising a cover which is movable and which selectively covers at least some of the plurality of bit retainers; and wherein the cover is rotatable.

2. The screwdriver of claim 1, wherein the bit holder further comprises a plate adjacent the bit retainers.

3. The screwdriver of claim 2, wherein the plate is configured to prevent axial movement of bits held by the bit retainers.

4. The screwdriver of claim 1, wherein the cover is movable to an open position in which at least one bit retainer is accessible to a user.

5. The screwdriver of claim 4, wherein when the cover is in the open position, the user can rotate the bit holder.

6. The screwdriver of claim 1, wherein there are at least three detents.

7. The screwdriver of claim 1, wherein the bit holder is fixed in an axial direction.

8. The screwdriver of claim 1, wherein the bit holder includes a substantially cylindrical body.

9. The screwdriver of claim 8, wherein the substantially cylindrical body is at least substantially hollow.

10. The screwdriver of claim 1, wherein the screwdriver includes a bit holder section including a bit holder housing and wherein the bit holder is rotatably mounted to the bit holder housing.

11. The screwdriver of claim 10, wherein the cover is mounted on the bit holder housing.

12. A screwdriver, comprising:

a housing comprising a handle section and a motor housing section, a longitudinal axis of the handle section being at an offset angle with respect to a longitudinal axis of the motor housing section;

a motor housed in the motor housing section;

a tool holder selectively driven by the motor;

a user actuatable trigger for activating the motor; and a bit holder rotatably held on the housing, the bit holder comprising a first section which includes a plurality of bit retainers and a second section including a plurality of detents;

wherein the screwdriver further comprises a pin which engages with the plurality of detents to hold the bit holder in one of a plurality of rotational positions; and wherein the bit holder has a longitudinal axis that is aligned with the longitudinal axis of the motor housing.

13. The screwdriver of claim 12, wherein the bit holder is rotatable around the bit holder longitudinal axis.

14. The screwdriver of claim 13, wherein the bit holder housing is integral with the handle section and the motor housing section.

15. The screwdriver of claim 14, wherein the cover has a window through which a user can see bits held by at least some of the bit retainers.

16. The screwdriver of claim 1, wherein the cover is rotatable about the longitudinal axis of the motor housing section.

17. A power tool, comprising:

a housing comprising a handle section and a motor housing section, a longitudinal axis of the handle section being at an offset angle with respect to a longitudinal axis of the motor housing section;

a motor housed in the motor housing section;

a tool holder selectively driven by the motor;

a user actuatable trigger for activating the motor; and a bit holder rotatably held on the housing, the bit holder comprising a first section which includes a plurality of bit retainers and a second section including a plurality of detents;

wherein the power tool further comprises a pin which engages with the plurality of dents to hold the bit holder in one of a plurality of rotational positions;

wherein the bit holder is located axially behind the motor housing section along the motor housing section longitudinal axis, wherein the tool holder side of the power tool constitute a forward direction; and wherein the bit holder has a longitudinal axis that is aligned with the longitudinal axis of the motor housing.

18. The power tool of claim 17, wherein the power tool further comprises a movable cover which selectively covers at least some of the plurality of bit retainers.

19. The power tool of claim 17, further comprising a movable cover which selectively covers at least some of the plurality of bit retainers;

wherein the movable cover is rotatable.

* * * * *